US008474593B2

(12) United States Patent
String

(10) Patent No.: US 8,474,593 B2
(45) Date of Patent: Jul. 2, 2013

(54) COIN PROCESSING MACHINE WITH DUAL SETS OF COIN SENSORS

(76) Inventor: Gregory F. String, Mechanicsburg, PA (US)

( * ) Notice: Subject to any disclaimer, the term of this patent is extended or adjusted under 35 U.S.C. 154(b) by 23 days.

(21) Appl. No.: 13/223,858

(22) Filed: Sep. 1, 2011

(65) Prior Publication Data

US 2013/0059515 A1 Mar. 7, 2013

(51) Int. Cl.
*G07D 5/02* (2006.01)

(52) U.S. Cl.
USPC ..... 194/334

(58) Field of Classification Search
USPC ..... 194/334–338
See application file for complete search history.

(56) References Cited

U.S. PATENT DOCUMENTS 5,141,443 A * 8/1992 Rasmussen et al. ..... 453/10
5,201,396 A * 4/1993 Chalabian et al. ..... 194/217
5,236,072 A * 8/1993 Cargill ..... 194/207
5,277,651 A * 1/1994 Rasmussen et al. ..... 453/10
5,392,892 A * 2/1995 Mulder ..... 194/334
5,483,583 A * 1/1996 Chen ..... 379/146
5,568,855 A * 10/1996 Hoffman et al. ..... 194/318
5,823,315 A * 10/1998 Hoffman et al. ..... 194/203
6,026,946 A * 2/2000 McCarty, Jr. ..... 194/317
6,412,620 B1 * 7/2002 Imura ..... 194/317
6,827,647 B1 * 12/2004 Loose et al. ..... 463/25
7,243,774 B2 * 7/2007 String ..... 194/350
2009/0191801 A1 * 7/2009 String ..... 453/6

* cited by examiner

*Primary Examiner* — Jeffrey Shapiro
(74) *Attorney, Agent, or Firm* — Hooker & Habib, P.C.

(57) ABSTRACT

A coin processing machine for processing coins of various diameters includes an elongate guide surface that guides coins moving along a coin path extending beside and along the guide surface, and sets of first and second coin sensors spaced along the path. Each first and second coin sensor is associated with a respective coin diameter. The coin sensor signals are transmitted to a controller that recognizes the value of a coin associated with a pair of first and second sensors only when both sensors signal the presence of a coin. If only the first sensor signals the presence of a coin, the controller may generate an output signal indicating the presence of a misaligned coin moving along the coin path.

19 Claims, 7 Drawing Sheets

COIN PROCESSING MACHINE WITH DUAL SETS OF COIN SENSORS

FIELD OF THE DISCLOSURE

The disclosure relates to coin processing machines for sorting, counting, or verifying coins or like tokens.

BACKGROUND OF THE INVENTION

Coin processing machines receive coins and sort, count, or verify the coins. A conventional coin processing machine may include a guide surface that defines a coin path that extends besides and along the guide surface. The guide surface may be straight or may be arcuate depending on the design of the machine.

A singulated, serial stream of coins roll or slide against the guide surface while moving along the coin path. Because the positions of the coins moving against the coin guide surface are accurately known, coin sensors are often placed in the guide path to sense the presence and denomination of the coins.

FIG. 6 illustrates in part a known coin processing machine 10 of this type. The coin processing machine 10 has proven in practice to be a reliable and durable device that accurately sorts, counts, or verifies coins at high speed.

Coin processing machine 10 has a stationary flat plate 12 that receives a stream of singulated coins (represented by the arrow 14) from a turntable (not shown). A stationary guide finger 16 is mounted on the plate 12. The guide finger 16 has an elongate, straight guide surface 18 that defines a coin path 20 extending on the plate 12 besides and along the guide surface 18. A coin drive (not shown) drives the stream of coins against the upstream end of the guide surface 18. The edges of the coins remain against the guide surface 18 as the coins slide on the plate 12 and move downstream along the coin path 20.

A set of coin sensors 22 is carried in the plate 12, the sensors 22 being serially spaced along the coin path 20 in order to sense a portion of a coin spaced from the guide surface 18 moving over the sensor. The sensors 22 are arranged downstream in order of decreasing coin diameter. Each sensor 22 is associated with a coin diameter/coin denomination that is the smallest diameter coin that would be sensed by the sensor 22 as the coin moves on the coin path 20 while against the guide surface 18. Because the sensors 22 are arranged in order of decreasing coin diameter, the illustrated coin sensors 22 are each respectively associated as one moves in the downstream direction with the current US half-dollar coin, US dollar coin, US quarter-dollar coin, US five-cent coin, US one-cent coin, and US ten-cent coin respectively.

Each coin sensor 22 generates a respective signal 23 representing the presence of a coin when a coin passes over the sensor. The signals are transmitted to a controller 24. The controller 24 generates an output signal representing the denomination of a coin passing the set of coin sensors 22 based on which coin sensor 22 first signals the presence of the coin. Operation of the controller 24 and sensors 22 is described in my U.S. Pat. No. 7,243,774 (which patent is incorporated by reference as if fully set forth herein) for a set of sensors serially spaced along a guide surface and so will not be described in great detail here.

The sensors 22 are arranged to first detect the largest diameter coin (in the illustrated embodiment a US half-dollar coin) and then detect each succeeding smaller-diameter coin as a coin in contact with the guide surface 18 passes sequentially past the sensors 22. The controller 24 determines which sensor 22 first generates a signal to determine the denomination of coin moving past the array of sensors and maintains a running count of the value and number of the coins processed by the coin processing machine 10.

In operation, it has been found that occasionally a coin received onto the plate 12, particularly a wet or oily coin of relatively small diameter, does not move against the guide surface 18 but remains spaced away from the guide surface 18 as the coin passes the sensors 22. See FIG. 7, which illustrates a coin D (a US ten-cent coin) that is not against the guide surface 18 but is instead moving along a misaligned coin path represented by the arrow 26. The coin D first passes over the most upstream sensor 22 as shown in the figure, which sensor generates a signal 28 that is incorrectly interpreted by the controller 24 as representing the presence of a half-dollar coin. The ten-cent coin D is valued in error as a half-dollar coin.

Thus there is a need to avoid errors in assigning values to coins that are not properly located against the guide surface as the coins move through the coin processing machine.

SUMMARY OF THE DISCLOSURE

Disclosured is an improvement to the coin machine 10 and its equivalents having coin sensors spaced along a guide rail. The improved coin processing machine better resists assigning a wrong value to coins that are not against the guide rail when being sensed.

An embodiment of the improved coin processing machine includes the set of coin sensors found in conventional coin processing machines that are serially spaced along a guide path that extends besides and along a guide surface. Each first coin sensor is associated with a respective denomination (diameter) of coin. The improved coin processing machine also includes a second set of coin sensors serially spaced along the coin path. The set of second coin sensors includes at least one second coin sensor, each second coin sensor also associated with a respective denomination of coin. Each second sensor is spaced closer to the guide surface than the associated first sensor whereby a coin moving along the coin path with its edge against the guide surface will at some point along the path simultaneously face both first and second coin sensors associated with the coin's diameter and cause said sensors to each generate a signal. The controller is configured to recognize and count the value of a coin of a denomination of coin associated with the set of second coin sensors only when the first and second sensors associated with the coin simultaneously signal the presence of a coin.

Thus using the example given above of a ten-cent coin moving along a misaligned guide path, the coin may cover the first sensor associated with a half-dollar coin but would not also cover the second sensor associated with a half-dollar coin. The controller would receive a signal from the first sensor but not from the second sensor. Since the first and second sensors would not simultaneously signal the presence of a coin, the controller would not generate an output signal.

The coin moving along the misaligned coin path can be diverted after moving downstream past the guide surface and separated from the sensed coins for later handling. Thus the detection of a coin moving along a misaligned coin path can be used to generate a signal to actuate a diverter or equivalent structure.

In preferred embodiments of the improved coin processing machine, the set of second coin sensors may be less than the set of first coin sensors. It has been found that as a general rule that smaller-diameter coins are more likely to be misaligned moving along the coin path than are larger-diameter coins.

Thus second coin sensors may be provided for only larger diameter coins and omitted for smaller diameter coins, depending on the machine, its design, and observed misalignment of coins as a function of coin diameter.

Adding a set of second sensors as described to verify that a coin of the type associated with the signal from the first sensor is on the desired coin path has reduced miscounts and improved accuracy. Furthermore, the disclosed features can be readily retrofitted to many existing types of coin processing machines, with some changes to the controller programming to omit generating a signal if both first and second coin sensors do not simultaneously signal the presence of a coin, and to optionally generate a signal representing detection of a misaligned coin.

Other objects and features will become apparent as the description proceeds, especially when taken in conjunction with the accompanying drawing sheets.

BRIEF DESCRIPTIONS OF THE DRAWINGS

DESCRIPTION OF THE PREFERRED EMBODIMENT

Figure 1:
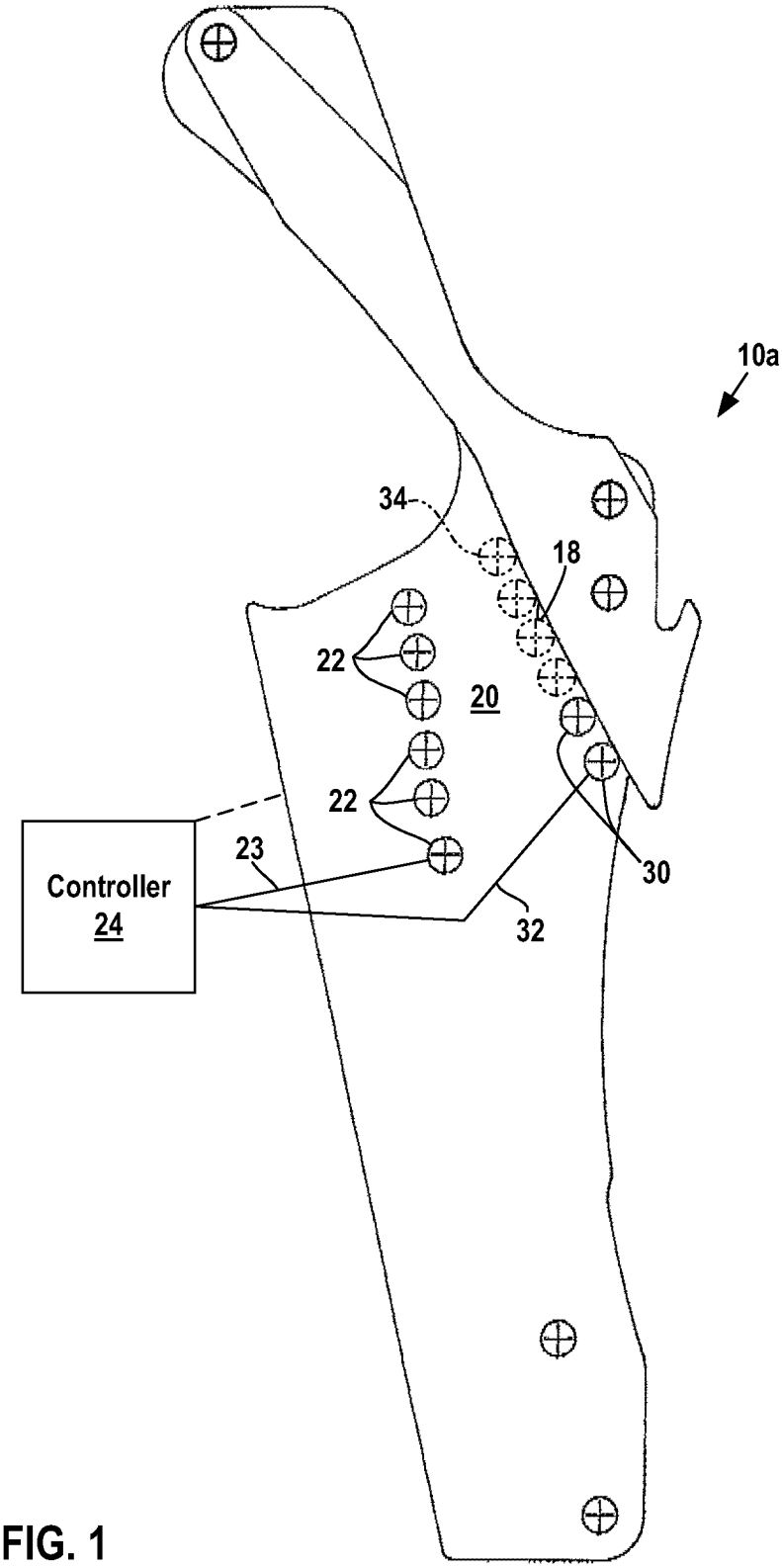
FIG. 1 is a top view of a portion of a coin processing machine.
Figure 6:
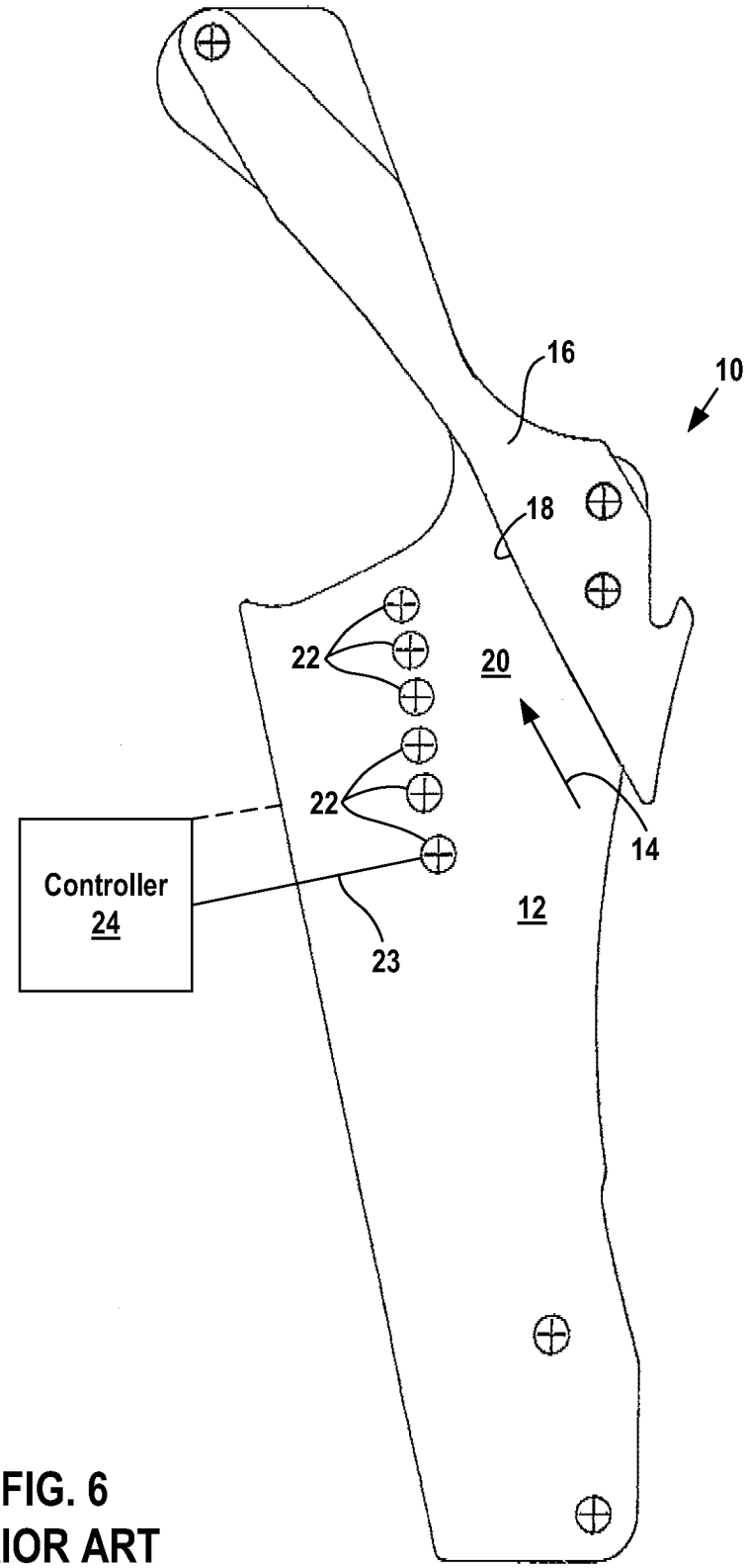
FIG. 6 PRIOR ART
FIG. 6 is a view similar to FIG. 1 of a portion of a prior art coin processing machine.
Figure 7:
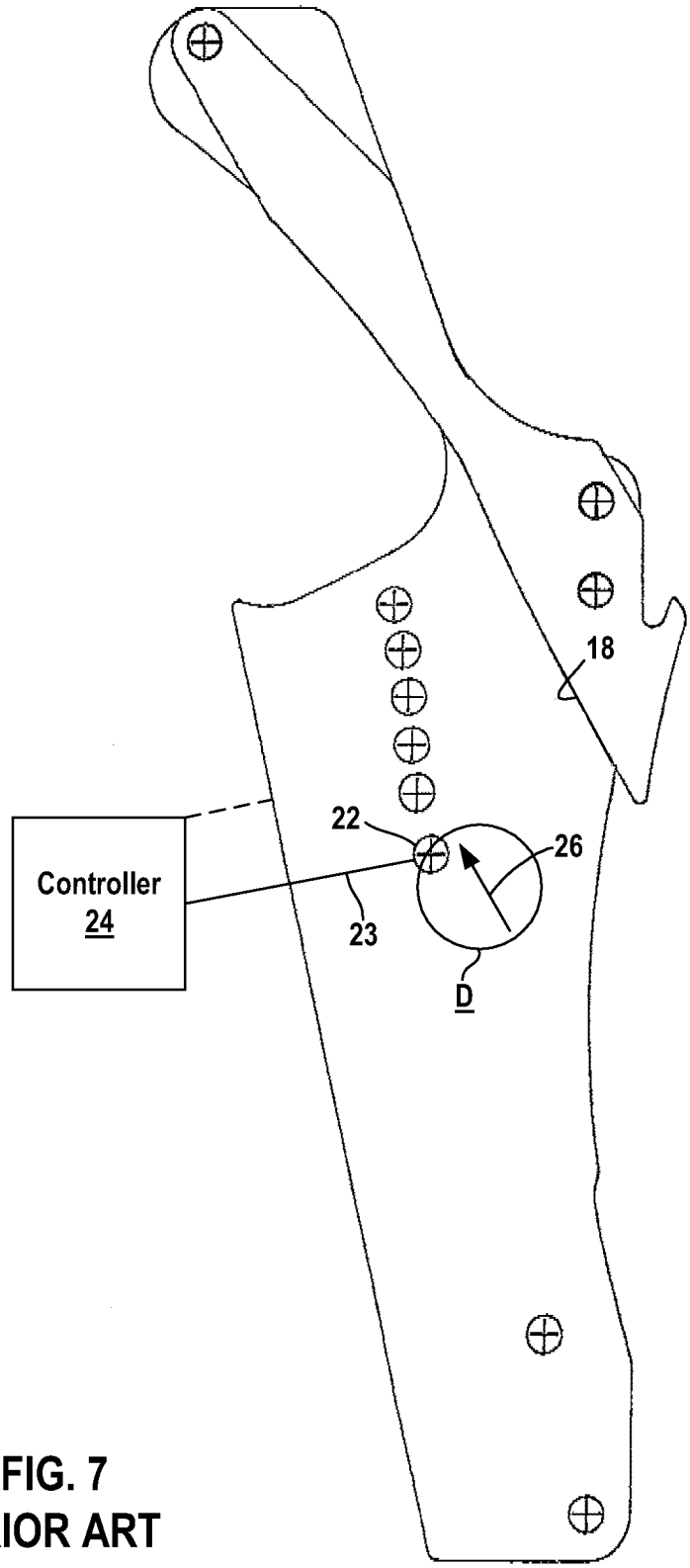
FIG. 7 PRIOR ART
FIG. 7 is a view similar to FIG. 6 but illustrates a coin on a misaligned coin path of the prior art coin processing machine.

FIG. 1 illustrates a machine 10*a* similar to the machine 10 shown in FIGS. 6 and 7 but modified. Only the modifications are discussed, it being understood that unmodified component parts of the machine 10 remain as previously described.

The coin sensors 22 represent a set of first coin sensors 22. A set of second coin sensors 30 is carried in the plate 12, the sensors 30 being serially spaced along the coin path 20 and closely spaced from the guide surface 18. The second sensors 30 are serially spaced along a path corresponding to the shape of the guide surface 18 (which in the illustrated embodiment would be along a straight line path). Each second coin sensor 30 generates and transmits a respective signal 32 to the controller 24 indicating the presence of a coin over the second coin sensor.

The illustrated embodiment has two second coin sensors 30, but other embodiments could include additional second coin sensors 32 (shown in phantom in FIG. 1) up to a total of second coin sensors 34 equaling the number of first coin sensors 22.

Each second sensor 30 is associated with a respective first coin sensor 22 such that a coin associated with the first coin sensor 22 will simultaneously face and cover both of the sensors 22, 30. The most upstream second coin sensor 30 is associated with the most upstream first coin sensor 22 that in turn is associated with a half-dollar coin. The next downstream coin sensor 30 is associated with the next downstream first coin sensor 22 which in turn is associated with a one-dollar coin. Each second coin sensor 32 is positioned along a line from its associated first coin sensor 22 that is perpendicular to the guide surface 18 so that a coin of the type associated with the pair of sensors 22, 30 will simultaneously face and cover both sensors 22, 30 at some point as the coin moves along the guide path 20.

When the pair of associated first and second sensors 22, 30 are covered by the coin associated with the sensors, the sensors 22, 30 will simultaneously transmit data signals 23, 32 to the controller 24. The controller 24 determines which sensor 22 first generates the signal to provisionally determine the denomination of the coin. However, the controller 24 will recognize the value of the coin only if both data signals 23, 32 are simultaneously present and will not recognize the value of the coin if only one of the data signals 23, 32 is present.

Figure 2:
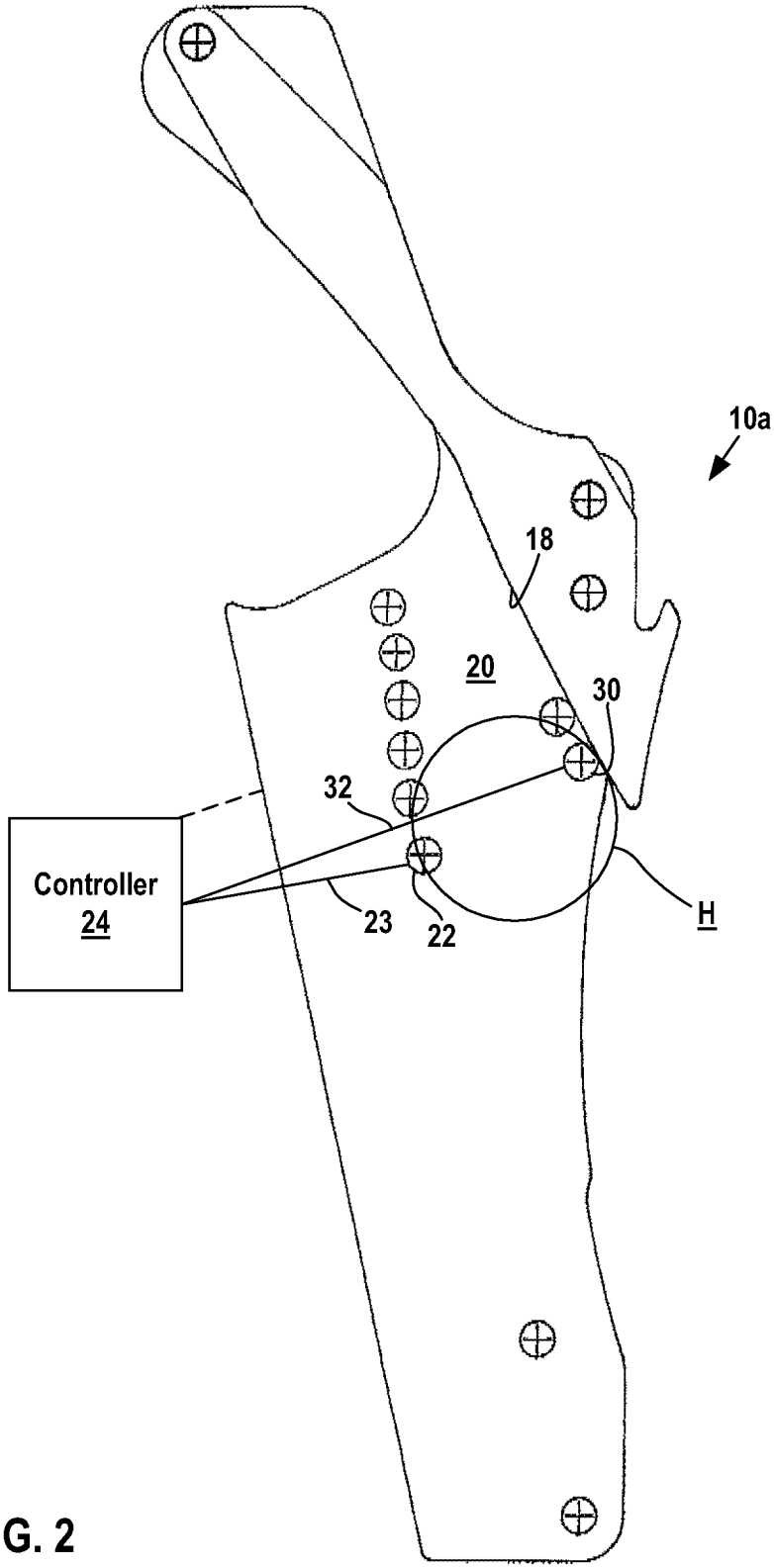
FIG. 2 is similar to FIG. 1 but illustrates a first coin on the coin path of the coin processing machine.

Operation of an associated pair of first and second sensors 22 and 30 is illustrated in FIG. 2 which is a "snapshot" of a half-dollar coin H moving along the coin path 20. The coin H is against the guide edge 18 and is simultaneously covering the first and second sensors 22, 30 associated with the half-dollar coin (the most upstream pair of sensors 22, 30). The sensors 22, transmit respective signals 23, 32 and the controller 24 recognizes from the simultaneous signals the presence of a half-dollar coin and adds 50 cents to the running total.

As the half-dollar coin H moves downstream and successively covers the further downstream sensors 22, 30, the controller 24 is programmed to ignore these signals as being generated by the already counted half-dollar coin moving downstream past the sensors.

Figure 3:
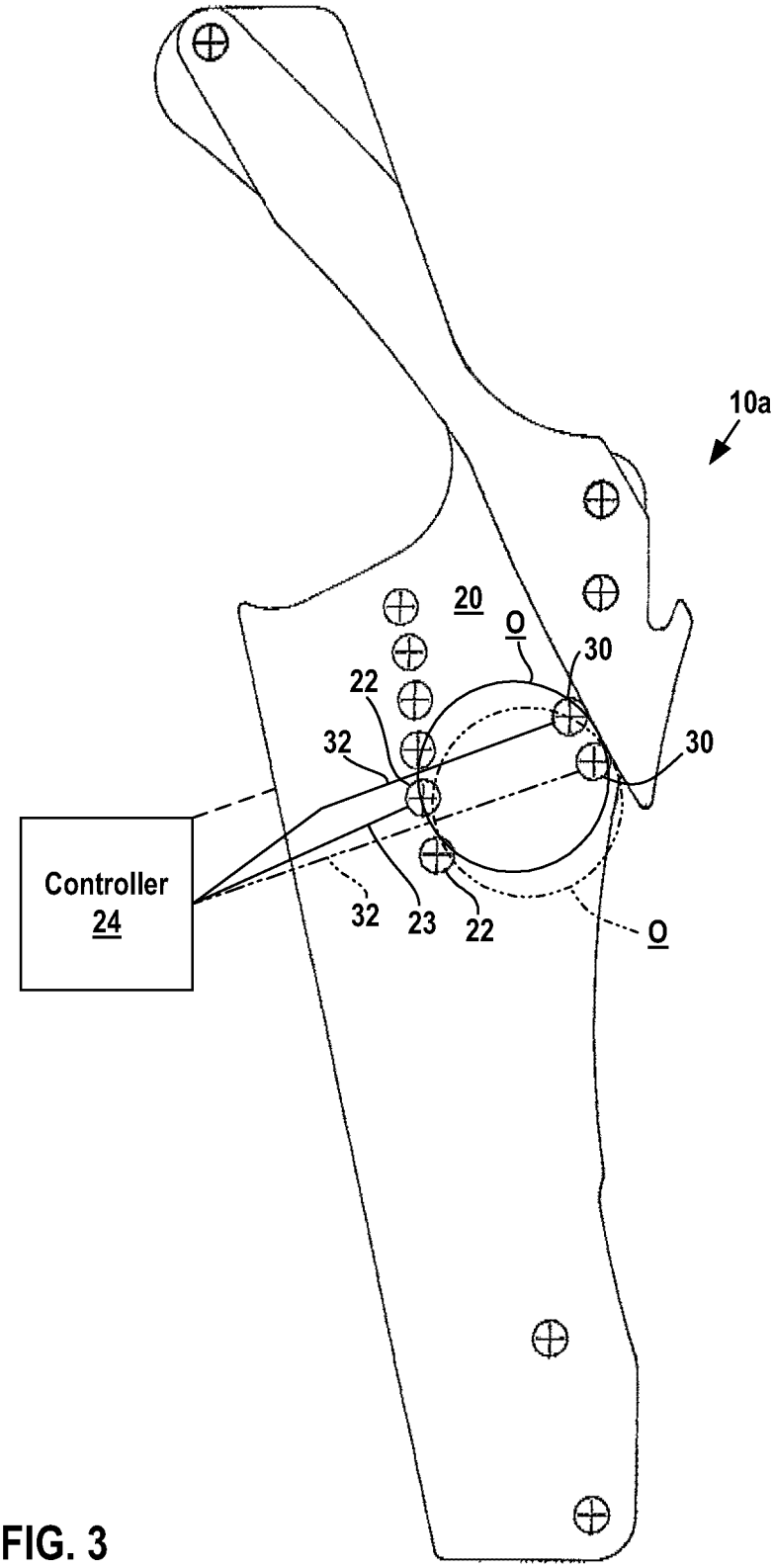
FIG. 3 is similar to FIG. 1 but illustrates a second coin on the coin path of the coin processing machine.

FIG. 3 illustrates two "snapshots" of a one-dollar coin O moving along the coin path 20. The coin O is shown in solid line when it simultaneously covers the sensors 22, 30 associated with a quarter-dollar coin (the next downstream pair of sensors) and is shown in phantom line in its earlier, more upstream position where it passes the upstream set of sensors 22, 30 associated with the half-dollar coin.

When the coin O passes the most upstream pair of sensors 22, 30 as shown in phantom line, the coin O covers on the sensor 30. The sensor 30 generates a signal 32 (also shown in phantom) but the sensor 22 is not covered and does not generate a signal. At that point the controller receives only the signal 32 and so does not evaluate the denomination of the coin because there is no simultaneous signal from the sensor 22.

When the coin O reaches the next downstream pair of sensors 22, 30 as shown in solid line, the coin O simultaneously covers the sensors 22, 30. The sensors 22, 30 both transmit respective signals 23, 32 to the controller 24. The controller 24 recognizes from the simultaneous signals the presence of a quarter-dollar coin and adds one dollar (one-hundred cents) to the running total.

As the coin O moves downstream and successively covers the next downstream sensors 22, 30, the controller 24 is programmed to ignore these signals as being generated by the already counted one-dollar coin moving downstream past the sensors.

Figure 4:
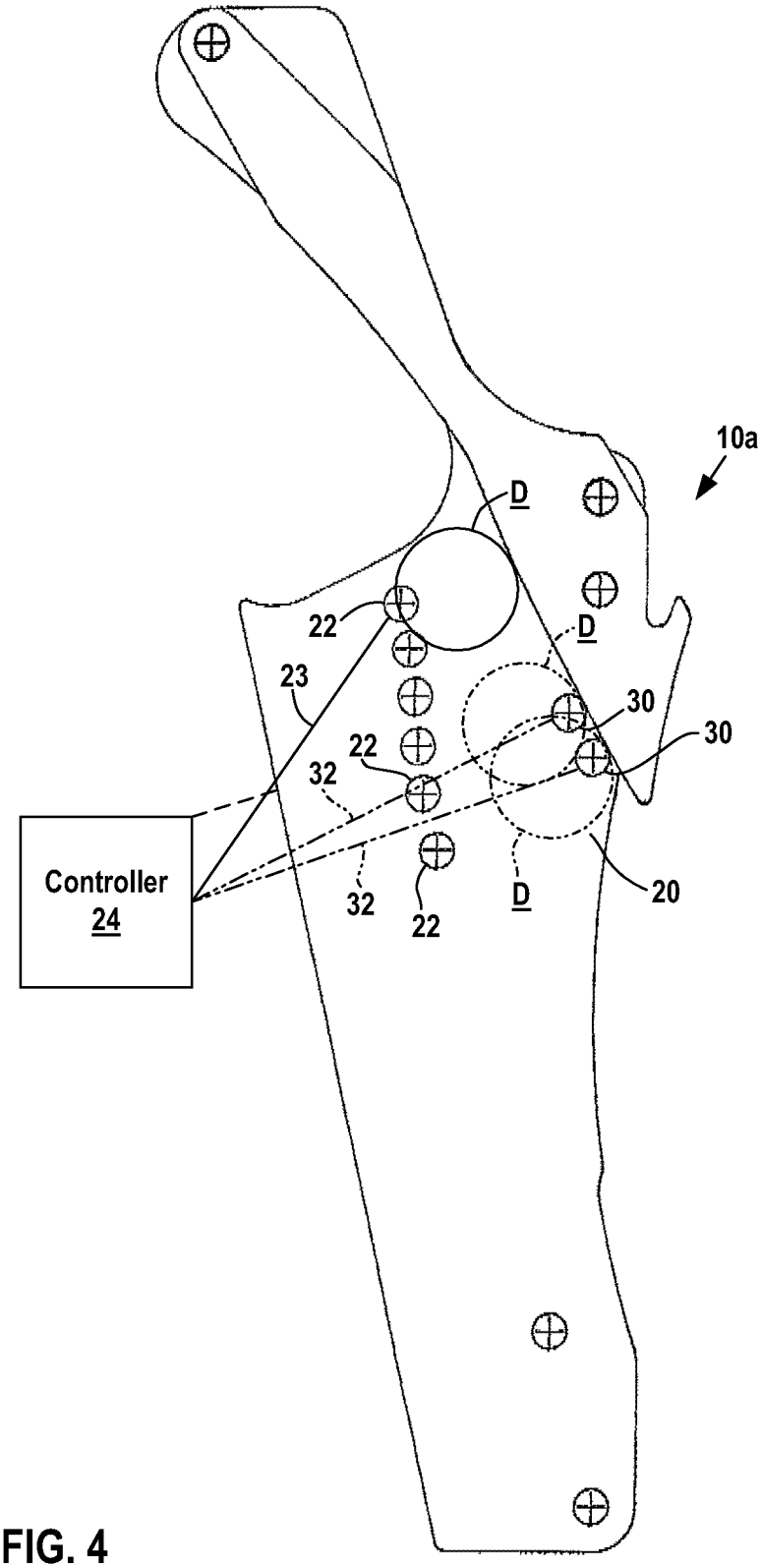
FIG. 4 is similar to FIG. 1 but illustrates a third coin on the coin path of the coin processing machine.

FIG. 4 illustrates three "snapshots" of a ten-cent coin D moving along the coin path 20. The coin D is shown in solid line when it covers the most downstream sensor 22, which sensor 22 is associated with ten-cent coins. This first sensor 22 does not have an associated second sensor 30. The coin D is shown in phantom lines in two of its earlier, more upstream positions where the coin D passes each pair of the two pairs of associated first and second sensors 22, 30.

When the coin D passes each pair of pairs of sensors 22, 30 the coin D covers only the sensor 30 of the pair. The sensor 30 generates a signal 32 but the controller 24 does not recognize the coin because there is no simultaneous signal generated by the other sensor 22 of the pair as described earlier above with respect to the coin Q.

As the coin D moves further downstream to the position shown in solid line, the coin D covers only the sensor 22 associated with a ten-cent coin, that is, the most downstream sensor 22. Because this sensor 22 is not associated with a second sensor 30, the controller 24 is programmed in a conventional manner to recognize the presence of a ten-cent piece by the downstream sensor 22 being the first sensor 22 to generate a signal 23 indicating the presence of a coin.

Figure 5:
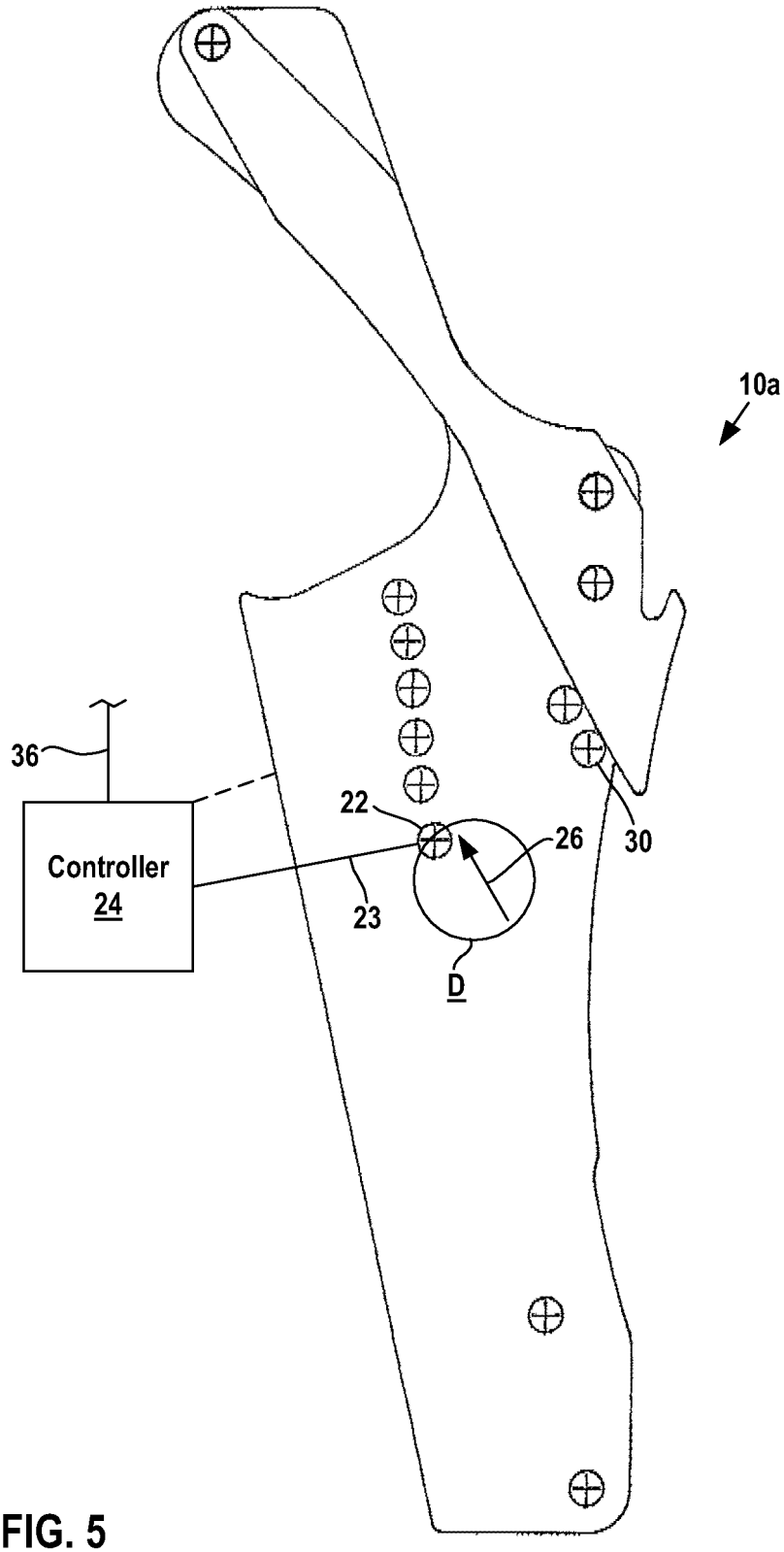
FIG. 5 is similar to FIG. 1 but illustrates a fourth coin on a misaligned coin path of the coin processing machine.

FIG. 5 illustrates the coin processing machine 10*a* with a ten-cent coin D moving along a misaligned coin path 26, corresponding to the condition machine state shown in FIG. 7 for the coin processing machine 10. The coin D first passes over the most upstream sensor 22 as shown in the figure, which sensor generates a signal 23. However, the coin D cannot cover the associated second sensor 30. The controller 24 only receives the signal 23 and so does not assign a value to the coin as previously described.

Furthermore, the controller 24 can be programmed to generate an output signal 36 representing a misaligned coin condition if only the sensor 22 of a pair of associated sensors 22, 30 generates a coin presence signal 23. Properly aligned coins that can cover the sensor 22 of a pair of associated sensors 22, 30 would also cover the other sensor 30 of the pair. Thus having only the sensor 22 of the associated pair of sensors 22, 30 generate a signal would be caused by a misaligned coin moving over the sensor 22 and not the other sensor 30.

The illustrated coin processing machine 10*a* has only two pairs of associated first and second sensors 22, 30, the first pair of sensors 22, 30 being at the upstream end of the coin path 20 and the other pair of first and second sensors 22, 30 being the next adjacent downstream sensors. The rationale for this is that coins smaller in diameter than the one-dollar coins are the only coins that exhibit possibly failing to move against the guide surface 18 when entering the coin path 20. Such smaller coins essentially always pass over the sensor 22 associated with either the half-dollar coin or the one-dollar coin when moving along a misaligned coin path. Eliminating the second coin sensors 30 that would be associated with these smaller-diameter coins reduces cost but does not reduce the counting accuracy. As mentioned earlier however, additional one or more coin sensors 30 could be provided. If pairs of first and second coin sensors 22, 30 are provided for each coin denomination, the controller 24 may be programmed to recognize the value of a coin only when both sensors 22, 30 associated with that coin diameter signal the presence of a coin.

It should be understood that although the illustrated embodiments are described in relation to US denomination coins, this is not limiting and embodiments can be readily adapted for use with coin denominations of other countries, tokens, or similar sets of objects.

The second sensors 30 as illustrated are immediately adjacent the guide surface 18. By "immediately adjacent" it is meant that the sensors 30 are spaced as closely to the guide surface 18 as manufacturing tolerances and the construction of the sensors 30 allow. In other embodiments one or more of the second sensors 30 can be spaced a greater distance from the guide surface 18 if some misalignment of coins moving downstream past the guide surface 18 can be tolerated.

While I have illustrated and described a preferred embodiment or embodiments, it is understood that this is capable of modification, and I therefore do not wish to be limited to the precise details set forth, but desire to avail myself of such changes and alterations as fall within the purview of the following claims.

What I claim as my invention is:

1. A coin processing machine for serially processing coins of various denominations, each denomination coin having a respective coin diameter different than the diameters of coins of other denominations, each coin having an annular outer edge extending around opposite faces of the coin, the coin processing machine comprising:

a guide surface, a set of at least two first coin sensors, a set of second coin sensors, and a controller for generating an output signal representing the denomination of a coin being processed by the coin machine;

each coin sensor in the first and second sets of coin sensors capable of generating a signal representing the presence of a coin when a coin faces the coin sensor, the control system receiving the signals generated by the coin sensors;

the guide surface having a length, the guide surface defining a side of a coin path extending in a downstream direction beside and along the length of the guide surface;

the first coin sensors serially spaced along the coin path, the first coin sensors spaced in the downstream direction successively closer to the guide surface, each first coin sensor associated with a respective coin diameter whereby a coin associated with a respective first coin sensor moving downstream along the coin path with the edge of the coin against the guide surface would be sensed by such first coin sensor and a coin having a smaller diameter than the coin associated with such first coin sensor moving downstream along the coin path with the edge of the coin against the guide surface would not be sensed by such first coin sensor;

the set of second coin sensors along the coin path and comprising at least one second coin sensor, each second coin sensor associated with a respective coin diameter and disposed to sense each coin moving downstream along the coin path with the edge of the coin against the guide surface;

the sets of first and second coin sensors disposed along the coin path wherein a coin of a diameter associated with a second coin sensor moving downstream along the coin path with the edge of the coin against the guide surface will at some point along the coin path simultaneously face both said second coin sensor and the first coin sensor associated with that coin's diameter, the second coin sensor associated with that coin diameter spaced closer to the guide surface than the first coin sensor associated with that coin diameter; and the controller being configured to generate output signals representing the denominations of coins associated with each of the first coin sensors, the controller being configured to generate a first output signal representing the denomination of any of the one or more coin denominations associated with the second set of sensors only when the first and second coin sensors associated with said coin diameter simultaneously signal the presence of a coin and to not generate a second output signal representing some other denomination of the coin in response to any downstream coin sensor subsequently signaling the presence of the coin after the first output signal is generated as the coin moves along the coin path.

2. The coin processing machine of claim 1 wherein the set of second sensors comprises said at least one second sensor and at least one additional second coin sensor, the set of second coin sensors spaced serially along the coin path.

3. The coin processing machine of claim 2 wherein the set of first coin sensors extends along a first line not parallel with the guide surface and the set of second coin sensors extends along a second line parallel with the guide surface.

4. The coin processing machine of claim 1 wherein the second coin sensors are spaced along a line parallel with the guide surface.

5. The coin processing machine of claim 1 wherein the number of first coin sensors in the set of first coin sensors is greater than the number of second coin sensors in the set of second coin sensors whereby one or more of the first coin sensors are not associated with any second coin sensor, the controller being configured to generate an output signal representing a denomination of a coin when an unassociated first coin sensor signals the presence of the coin and no upstream first coin sensor had signaled the presence of the coin.

6. The coin processing machine of claim 5 wherein the second coin sensors and the first coin sensors associated with said second coin sensors are upstream of the first coin sensors that are not associated with any second sensor.

7. The coin processing machine of claim 1 comprising a body having a flat surface that supports the coins while the coins are moving along the coin path, the guide surface extending away from said surface.

8. The coin processing machine of claim 7 wherein the sets of first and second coin sensors are mounted in said body.

9. The coin processing machine of claim 7 wherein the controller is configured to generate a misalignment signal if only the first coin sensor and not the second coin sensor associated with a coin diameter signals the presence of a coin.

10. The coin processing machine of claim 1 wherein each second coin sensor and the first coin sensor associated therewith are spaced apart from one another along a straight line perpendicular to the guide surface.

11. The coin processing machine of claim 1 wherein each second coin sensor is disposed immediately adjacent the guide wall.

12. An assembly for serially evaluating the denomination of coins in a singulated coin stream moving in a downstream direction along a path, each denomination coin having a respective coin diameter different than the diameters of coins of other denominations, each coin having an annular outer edge extending around opposite faces of the coin, the assembly comprising:

a guide surface, two or more first coin sensors, and one or more second coin sensors, each second coin sensor and a respective one of the first coin sensors being a respective pair of coin sensors, and a controller for generating an output signal representing the denomination of a coin being processed by the assembly;

the guide surface extending in the downstream direction along the path whereby a coin having the edge of the coin against the guide surface while moving downstream along the guide surface is moving on the path;

each of the first and second coin sensors being disposed along the coin path and capable of sensing a coin and thereby generating a signal representing the presence of a coin when a coin moving along the coin path faces the coin sensor, the controller receiving the signals generated by said first and second coin sensors;

the first coin sensors spaced apart in the downstream direction and arranged in the downstream direction successively closer to the guide surface, each first coin sensor associated with a respective coin diameter and spaced from the guide surface to sense a coin of said diameter moving on the coin path but not smaller diameter coins, and each second coin sensor being disposed to simultaneously sense the presence of a coin with the sensing of the same coin by the first coin sensor paired with the second coin sensor;

the controller capable of generating output signals representing the denomination of coins moving along the coin path in response to signals received from the coin sensors, the controller being configured to generate an output signal representing the denomination of a coin when the first coin sensor associated with the coin signals the presence of a coin but configured to not generate an output signal if the first coin sensor associated with the coin is paired with a second coin sensor but the second coin sensor does not simultaneously signal the presence of the coin; and the controller being configured to not transmit an output signal representing the denomination of a coin if any coin sensor downstream from the first coin sensor associated with the coin signals the presence of the same coin.

13. The assembly of claim 12 wherein there are more first coin sensors than there are second coin sensors, the one or more first coin sensors paired with the one or more second coin sensors being upstream from the other first coin sensors.

14. The assembly of claim 12 comprising a body having a flat surface, the coins moving on said surface when moving along the coin path, the first and second coin sensors mounted in said body.

15. The assembly of claim 12 wherein the one or more second coin sensors consists of only one second coin sensor.

16. The assembly of claim 15 wherein the at least one second coin sensor comprises a plurality of second coin sensors, the plurality of second coin sensors disposed along a line parallel with the guide surface.

17. The assembly of claim 12 wherein each second coin sensor and the first coin sensor paired with the second coin sensor define a straight line perpendicular to the guide surface.

18. The assembly of claim 12 wherein the guide surface extends downstream along a straight line.

19. The assembly of claim 12 wherein the controller is configured to generate a misalignment signal if the first coin sensor associated with the coin is paired with a second coin sensor but the second coin sensor does not simultaneously signal the presence of the coin.

* * * * *